US007575802B2

(12) United States Patent
Chatani et al.

(10) Patent No.: US 7,575,802 B2
(45) Date of Patent: Aug. 18, 2009

(54) COATED PRINTING PAPERS

(75) Inventors: Akinobu Chatani, Tokyo (JP); Koji Okomori, Tokyo (JP); Hiroshi Koyamoto, Tokyo (JP); Hitoshi Nagao, Tokyo (JP); Hirokazu Morii, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 11/290,833

(22) Filed: Dec. 1, 2005

(65) Prior Publication Data

US 2006/0137841 A1 Jun. 29, 2006

(30) Foreign Application Priority Data

Dec. 2, 2004 (JP) ..... 2004-350477

(51) Int. Cl.
*C08J 7/04* (2006.01)

(52) U.S. Cl. ..... 428/341; 428/32.34; 428/32.35; 428/195.1; 428/211.1; 428/340

(58) Field of Classification Search ..... 428/32.34, 428/32.35, 195.1, 211.1, 340, 341
See application file for complete search history.

(56) References Cited

U.S. PATENT DOCUMENTS

| | | | | |
|---|---|---|---|---|
| 6,273,995 | B1 | 8/2001 | Ikeda et al. | |
| 6,599,392 | B1 * | 7/2003 | Tadokoro et al. | 162/158 |
| 7,101,459 | B2 * | 9/2006 | Nisogi et al. | 162/135 |
| 2003/0041759 | A1 * | 3/2003 | Suda et al. | 101/467 |
| 2005/0255259 | A1 * | 11/2005 | Nakane et al. | 428/32.5 |

FOREIGN PATENT DOCUMENTS

| | | | |
|---|---|---|---|
| JP | 54148821 | A * | 11/1979 |
| JP | 10-226983 | | 8/1998 |
| JP | 11-200284 | | 7/1999 |
| JP | 11-350380 | | 12/1999 |
| JP | 2000-129595 | | 5/2000 |
| JP | 2003-96694 | | 4/2003 |
| JP | 2003-96695 | | 4/2003 |
| WO | WO 98/03730 | | 1/1998 |
| WO | WO 02/01000 | * | 1/2002 |

* cited by examiner

*Primary Examiner*—Bruce H Hess
*Assistant Examiner*—David J Joy
(74) *Attorney, Agent, or Firm*—Roylance, Abrams, Berdo & Goodman, L.L.P.

(57) ABSTRACT

The present invention aims to provide coated printing papers having fast ink drying properties comparable to those of conventional newsprint, without stickiness, having good printability such as sharpness of printed images comparable to those of coated papers, as well as having the effect of decomposing harmful substances by exposure to light, especially when using penetration drying type news inks.

A coated printing paper is provided, comprising a coating layer containing a pigment and an adhesive on a base paper, characterized in that a fine titanium oxide powder having a photocatalytic effect is contained in the coating layer and that the coated paper has an oil absorbency of 20 g/m$^2$ or more under pressure and a Bekk smoothness of 75 seconds or less.

16 Claims, No Drawings

COATED PRINTING PAPERS

CROSS-REFERENCE TO RELATED APPLICATION

This application claims the benefit under 35 U.S.C. § 119 of Japanese Patent Application No. 350477/2004, filed Dec. 2, 2004, which is hereby incorporated by reference in its entirety.

BACKGROUND OF THE INVENTION

The present invention relates to coated printing papers having good printability, good color print quality and air cleaning effect, especially those on which news ink is used.

Against the background of growing demands for removing harmful substances in daily life such as offensive odors, along with a growing awareness of the need to protect the environment, titanium oxides are drawing attention. Such oxides have been conventionally used as pigments for papermaking on account of their good opacity; and techniques for supporting fine titanium oxides on paper are under development in order to effectively utilize their known ability to induce redox reactions by using light energy to decompose various harmful substances in the atmosphere. For example, a photocatalytic paper internally containing a water-soluble polymer and a photocatalytic material such as a titanium oxide has been disclosed (see patent document 1), but the inclusion of a photocatalytic material within paper layers is neither efficient nor sufficiently effective because it produces its catalytic effect by exposure to light. In order to increase catalytic efficiency, it is thought that a photocatalytic material should be supported as close as possible to a paper surface; or most effectively, paper should be coated with the material. For example, a method has been disclosed by which fine titanium oxide are bonded to an inorganic binder such as colloidal silica and bonded around it by an organic adhesive (see patent document 2). However, such paper is not common and there is limited incentive to use them in view of current environmental awareness. Photocatalytic technologies would be most effectively utilized if they could be applied to e.g., the cover pages of newspapers because currently the most common papers are printing papers, and especially newspapers are published everyday.

Recently, with the growth of various printing technologies there is a growing trend in employing multicolor printing and using printing press with greatly improved printing speed. This tendency is also seen in newspaper printing. Multicolor printing of newsprint paper takes place under conventional printing conditions, i.e. penetration drying type inks are used for printing on conventional newsprint by high-speed coldset rotary presses to meet the need for immediate mass printing typical of newspaper printing and for cost-related reasons. However, when paper is coated by conventional methods, the ink drying properties of the paper are very poor. Therefore, when using penetration drying type inks on such paper printed by high-speed coldset rotary presses, there remains some undried ink which is deposited on guide rolls and transferred to the paper which will cause the final quality to deteriorate.

REFERENCES

Patent document 1: JPA HEI 10-226983.

Patent document 2: JPA 2000-129595.

Under such circumstances, an object of the present invention is to provide coated printing papers having fast ink drying properties comparable to those of conventional newsprint, without stickiness, having good printability such as sharpness of printed images comparable to those of coated papers, as well as having the effect of decomposing harmful substances by exposure to light, especially when using penetration drying type news inks.

SUMMARY OF THE INVENTION

As a result of careful studies to achieve the above object, we found that a coated printing paper having good ink drying properties of prints, little stickiness, good printability, and good reproducibility and sharpness of color printed images, as well as having the effect of decomposing harmful substances by exposure to light can be obtained by providing a coated paper comprising a coating layer containing a pigment and an adhesive on a base paper wherein a fine titanium oxide having a photocatalytic effect is contained in the coating layer and the coated paper has an oil absorbency of 20 g/m$^2$ or more under pressure and a Bekk smoothness of 75 seconds or less. It is thought that retransfer to rolls of printing press or the like or the resulting stain on the surface of printing can be reduced by adjusting the coated paper at an oil absorbency under pressure of 20 g/m$^2$ or more and a Bekk smoothness of 75 seconds or less because news inks or the like moderately penetrate the coated paper during printing to contribute to good ink receptivity and ink drying properties and reduced stickiness and inks are deposited on the surface of the coated paper having low smoothness. In the present invention, the base paper preferably contains an organic compound having the effect of inhibiting interfiber binding of pulp. Preferably, the fine titanium oxide is contained at 5 parts by weight or more and the fine titanium oxide and calcium carbonate are contained at 30 parts by weight or more per 100 parts by weight of the pigment.

ADVANTAGES OF THE INVENTION

According to the present invention, coated printing papers can be obtained having fast ink drying properties comparable to those of conventional newsprint, without stickiness, having good printability such as sharpness of printed images comparable to those of coated papers, as well as having the effect of decomposing harmful substances by exposure to light, especially in printing using penetration drying type news inks.

DETAILED DESCRIPTION OF THE INVENTION

In the present invention, coated printing paper having defined smoothness and oil absorbency are obtained by coating a specific pigment on a base paper.

It is important that the coated printing paper of the present invention has a Bekk smoothness of 75 seconds or less. If the Bekk smoothness is more than 75 seconds, the paper surface becomes stained, resulting in poor printability. This is probably because the inks supplied to the paper surface during printing may be retransferred to rolls of printing press or the like once they have been transferred to the printing paper and thereby the paper surface is more likely to be stained in the case of paper with high smoothness in contrast to papers with low smoothness in which inks are less likely to be transferred. More preferably, the Bekk smoothness is 10 seconds or more and 60 seconds or less.

It is also important that the coated printing paper of the present invention has an oil absorbency of 20 g/m$^2$ or more under pressure. The method for measuring the oil absorbency under pressure in the present invention uses AA-GWR Water Retention Meter from KALTEC. A coated paper test sample, a membrane filter (pore size 5.0 μm), and the accessory cup are placed in the instrument, and 1 ml of soybean oil is added from the top, and then the cup is tightly closed under a constant pressure (50 kPa) for a determined period (20 seconds), and then the amount of oil adsorbed into coated paper is measured. Normally, ink drying properties, i.e., the oil absorbency of papers is typically evaluated from the oil drop absorbency measured at normal pressures. However, actual printing conditions were not simulated and no definite correlation with printability such as paper surface stain or stickiness was observed by the oil drop absorbency measured at normal pressures because the inks on the blanket in offset rotary presses in fact set on paper under pressure between upper and lower cylinders. No correlation with printability is observed again according to JIS P 8130 defining a pressure set type oil absorbency test method. It was found that high correlation with printability is obtained by using the method of the present invention as described above. If the oil absorbency under pressure is less than 20 g/m$^2$, news inks are less likely to penetrate the coated paper during printing, resulting in poor ink receptivity on one side of the coated paper and poor ink drying properties to cause staining on the printed surface or stickiness. If the oil absorbency under pressure is too high, inks excessively penetrate the coated paper, resulting in decreased ink receptivity and poor reproducibility and sharpness of prints. The coated papers preferably have an oil absorbency of 25 g/m$^2$ or more and 250 g/m$^2$ or less under pressure.

The base paper in the present invention comprises pulp, fillers and various additives. Chemical pulp, mechanical pulp, de-inked pulp and the like can be used, but mechanical pulp and waste paper pulp derived from mechanical pulp are preferably contained at 60% by weight or less, most preferably not contained because they deteriorate and discolor upon exposure to light when they are excessively used.

In the base paper of the present invention, a bulking agent (density reducing agent) such as a surfactant is preferably used as an organic compound having the effect of inhibiting interfiber binding of pulp to reduce the density of the base paper and to balance oil absorbency and smoothness. The organic compound having the effect of inhibiting interfiber binding of pulp (hereinafter simply referred to as binding inhibitor) means a compound having a hydrophobic group and a hydrophilic group, and suitable binding inhibitors for the present invention are density reducing agents (or bulking agents) recently introduced on the market to increase the bulk of paper for papermaking, including e.g., compounds disclosed in WO98/03730, JPA HEI 11-200284, JPA HEI 11-350380, JPA 2003-96694, JPA 2003-96695, etc. Specifically, ethylene and/or propylene oxide adducts of higher alcohols, polyvalent alcohol-type nonionic surfactants, ethylene oxide adducts of higher fatty acids, ester compounds of polyvalent alcohols and fatty acids, ethylene oxide adducts of ester compounds of polyvalent alcohols and fatty acids, or fatty acid polyamide amines, fatty acid diamide amines, fatty acid monoamides, or condensation products of polyalkylene polyamine/fatty acid/epichlorohydrin can be used alone or as a combination of two or more of them. Ester compounds of polyvalent alcohols and fatty acids, fatty acid diamide amines, fatty acid monoamides, condensation products of polyalkylene polyamine/fatty acid/epichlorohydrin or the like are preferred. Commercially available bulking agents include Sursol VL from BASF; Bayvolume P Liquid from Bayer; KB-08T, 08W, KB110, 115 from Kao Corporation; Reactopaque from Sansho Co., Ltd.; PT-205 from Japan PMC Corporation; DZ2220, DU3605 from NOF Corporation; R21001 from Arakawa Chemical industries, Ltd., and these can be used alone or as a combination of two or more of them. The coated papers of the present invention preferably contain 0.1-10 parts by weight, especially 0.2-1.0 parts by weight of an inhibitor of interfiber binding of pulp per 100 parts by weight of the base paper to improve air permeability of the base paper.

In the present invention, known fillers such as amorphous silicates, amorphous silica, talc, kaolin, clay, precipitated calcium carbonate, ground calcium carbonate, titanium oxides and synthetic resin fillers can be used in an amount of about 3-20% by weight of pulp in the base paper. These fillers can be used alone or as a combination of two or more of them for the purpose of controlling papermaking suitability of stock or strength characteristics.

These stock can be added to with chemicals commonly used during papermaking processes, such as paper strength enhancers, sizing agents, antifoaming agents, colorants, softening agents or the like as needed in the range not inhibiting the effects of the present invention.

The base paper may be prepared by any process for papermaking acidic, neutral or basic papers using a Fourdrinier paper machine including a top wire or the like, a cylinder paper machine, a combination machine of both or a Yankee dryer machine or the like and may also be a mechanical base paper containing recycled paper pulp obtained from old newspapers. Base papers precoated with starch or polyvinyl alcohol using a size press, bill blade, gate roll coater, premetering size press or the like may also be used. Base papers having a basis weight of about 30-400 g/m$^2$ used for normal coated papers can be used as coating base papers, but preferably about 30-100 g/m$^2$ because the present invention relates to coated printing papers, especially coated papers suitable for use in rotary newspaper presses. In the present invention, the base paper preferably has a density of 0.3 g/cm$^3$ or more and 0.8 g/cm$^3$ or less, more preferably a density of 0.3 g/cm$^3$ or more and 0.6 g/cm$^3$ or less.

In the present invention, the ability to decompose harmful substances in the atmosphere by exposure to light can be conferred by using a fine titanium dioxide as a pigment. It is preferably contained in an amount of 5 parts by weight or more, more preferably 10 parts by weight or more and 50 parts by weight or less per 100 parts by weight of the pigment. The titanium oxide in the present invention can be prepared from not only titanium oxides but also any titanium oxide or hydroxide called wet titanium oxides, hydrated titanium oxides, metatitanic acid, orthotitanic acid, and titanium hydroxide. The titanium oxide used in the present invention preferably has a primary particle size of 2-150 nm. It preferably has a specific surface area of 10-350 m$^2$/g.

In the present invention, a mixture of a fine titanium dioxide and colloidal silica or alumina in a ratio of 5:1-1:5 is preferably used as a pigment in the coating color. Thus, coexisting organic adhesives can be inhibited from being decomposed. Preferably, a fine titanium oxide and a colloidal solution of silica or alumina are added in certain proportions, and after stirring for a given period, other pigments or additives are added.

In addition to the pigment as mentioned above, inorganic pigments such as precipitated calcium carbonate, ground calcium carbonate, clay, kaolin, engineered kaolin, delaminated clay, talc, calcium sulfate, titanium dioxide used for conventional papermaking, barium sulfate, zinc oxide, silicic acid, silicic acid salts, satin white; or organic pigments such as plastic pigments can also be used in the present invention. In the present invention, it is preferable to use calcium carbonate, especially ground calcium carbonate in terms of production costs and improvements in ink drying properties. Preferably, 30 parts by weight or more, more preferably 50 parts by weight or more of a mixture of calcium carbonate and titanium oxide is contained per 100 parts by weight of the pigment.

Adhesives used in the present invention can be selected as appropriate from one or more of conventional adhesives for coated papers, e.g., synthetic adhesives such as styrene-butadiene copolymers, styrene-acrylic copolymers, ethylene-vinyl acetate copolymers, butadiene-methyl methacrylate copolymers, vinyl acetate-butyl acrylate copolymers, or polyvinyl alcohols, maleic anhydride copolymers and acrylic-methyl methacrylate copolymers; proteins such as casein, soybean protein and synthetic proteins; starches such as oxidized starches, cationized starches, urea phosphate-esterified starches, hydroxyethyl etherified starches; and cellulose derivatives such as carboxymethyl cellulose, hydroxymethyl cellulose, hydroxyethyl cellulose. These adhesives are preferably used in a range of 5-50 parts by weight, more preferably 10-40 parts by weight per 100 parts by weight of the pigment. More than 50 parts by weight is not preferred because of disadvantage in runnability or the like, e.g., the resulting coatings becoming too viscous to readily pass through piping or screens. Less than 5 parts by weight is not preferred because of insufficient surface strength.

The coating color of the present invention may contain various conventional auxiliaries such as dispersants, thickeners, water-retention agents, antifoamers, water insolubilizers, dyes, optical brighting agents, etc.

The coating color prepared is applied in one or more layers on one or both sides of the base paper using a blade coater, bar coater, roll coater, air knife coater, reverse roll coater, curtain coater, size press coater, gate roll coater or the like. The range of the coat weight in which the present invention is effective is preferably 3 g/m$^2$ or more and 12 g/m$^2$ or less, more preferably 4 g/m$^2$ or more and 8 g/m$^2$ or less per side.

The wet coating layer is dried by using conventional means such as a steam heater, gas heater, infrared heater, electric heater, hot air dryer, microwave, cylinder dryer, for example.

After drying, the paper can be post-processed as needed to confer smoothness by carrying out finishing processes using a supercalender, a hot soft nip calender or the like. However, it can be processed by any calender or uncalendered so far as a coated paper of a desired quality can be obtained. Any other conventional paper processing means can also be applied.

EXAMPLES

The following examples specifically illustrate the present invention without, however, limiting the invention thereto as a matter of course. Unless otherwise specified, parts and % in the examples mean parts by weight and % by weight, respectively. Coating color and the obtained coated printing papers were tested by the following evaluation methods.

(Evaluation Methods)

(1) Oil absorbency under pressure: The oil absorbency under pressure as defined herein was determined using AA-GWR Water Retention Meter from KALTEC. First, six pieces of each coated paper test sample (5 cm×5 cm) (or any number of pieces adjusted as appropriate if the sample is highly absorbent) and a piece of a membrane filter (from KALTEC; pore size 5.0 μm) are laid on the supplied rubber mat and the supplied cup is placed thereon, and the assembly is inserted into the instrument. The assembly is raised by the clamp to come into close contact with the top of the instrument, and then 1 ml of soybean oil (from Wako Pure Chemical Industries, Ltd., Wako first-class quality) is injected via the liquid inlet at the top, and immediately the supplied cap is put on the cup to start measurements. After maintaining the pressure in the cup at 50 kPa for 20 seconds, the cup was opened and the weight of the coated paper sample was measured. The area measured is 8 cm$^2$. The weight gain corresponds to the weight of soybean oil absorbed by each paper under pressure and the weight of oil absorbed per m$^2$ was determined as oil absorbency under pressure herein.

Oil absorbency under pressure(g/m$^2$)=(paper weight after measurement(g)−paper weight before measurement (g))/(0.0008(m$^2$))

(2) Bekk smoothness: determined according to JIS P 8119.

(3) Ink receptivity: Printing was performed using an offset rotary press (4 colors) from Toshiba Machine Co., Ltd. with penetration drying type news inks for offset printing (Vantean Eco from Toyo Ink Mfg. Co., Ltd.) at a printing speed of 500 rpm, and the ink receptivity of the resulting print (solid print in three colors consisting of cyan, magenta and yellow) was visually evaluated according to the 4-class scale: ◎: very good, ○: good, Δ: slightly poor, X: poor.

(4) Ink drying properties: Immediately after printing using an RI press with a penetration drying type news ink for offset printing (Vantean Eco from Toyo Ink Mfg. Co., Ltd.), the resulting print (solid print in magenta simply) was transferred to a woodfree paper and the cleanness of the woodfree paper was visually evaluated according to the 4-class scale: ◎: very good, ○: good, Δ: slightly poor, X: poor.

(5) Print sharpness: Sharpness of the print in offset printing was visually evaluated according to the 4-class scale: ◎: very good, ○: good, Δ: slightly poor, X: poor.

(6) Stickiness: Stickiness of the print in offset printing was visually evaluated according to the 4-class scale: ◎: very good, ○: good, Δ: slightly poor, X: poor.

(7) Photocatalytic effect: A sheet was cut into 10 cm×15 cm and placed in a 5-liter quartz glass sealed vessel, and acetaldehyde gas was injected via a microsyringe to a concentration of 100 ppm in the vessel. The vessel was irradiated with UV rays using three 15-W black lights at a dose of 5.0 mW/cm$^2$ on the sheet surface. After 1 hr, the gas concentration in the vessel was measured by a Kitagawa gas detector tube to determine the decomposition rate (%), from which the photocatalytic effect was evaluated.

Example 1

In a Cellier mixer, 15 parts (solids) of a slurry of titanium oxide microparticles (CSB-M from Sakai Chemical Industry, Co., Ltd.) and 24 parts of colloidal silica (Snowtex 40 from Nissan Chemical Industries, Ltd.) were stirred for 1 hr. Into this mixed slurry was added a pigment slurry prepared by dispersing a pigment consisting of 40 parts of ground calcium carbonate (FMT-90 from Fimatec Ltd.) and 21 parts of fine clay (JapanGloss from HUBER) with a dispersant consisting of sodium polyacrylate (0.2 parts based on the inorganic pigment) in a Cellier mixer to prepare a pigment slurry having a solids content of 63%. To thus obtained pigment slurry were added 13 parts of a styrene/butadiene copolymer latex (glass transition temperature 20° C., gel content 85%) and 26 parts of a hydroxyethyl-etherified starch (PG295 from Penford Corporation) and water was further added to give a coating color having a solids content of 58%.

The base paper to be coated was a medium quality paper having a basis weight of 50 g/m$^2$ prepared from papermaking pulp consisting of 30% mechanical pulp and 70% chemical pulp and containing 7%, on the basis of the weight of the base paper, of light calcium carbonate as a filler and 0.3%, on the basis of the weight of the base paper, of an ester compound of a polyvalent alcohol and a fatty acid (KB-110 from Kao Corporation) as an organic compound having the effect of inhibiting interfiber binding of pulp.

The base paper was coated with the coating color on both sides at a coating mass of 5 g/m$^2$ per side using a blade coater at a coating speed of 700 m/min and dried to a moisture content of 5% in coated paper to give a coated printing paper.

Example 2

A coated printing paper was obtained by the same procedure as in Example 1 except that the composition of the pigment slurry in Example 1 was changed to 10 parts (solids) of the slurry of titanium oxide microparticles, 16 parts of colloidal silica, 50 parts of ground calcium carbonate, and 24 parts of fine clay.

Example 3

A coated printing paper was obtained by the same procedure as in Example 1 except that the composition of the pigment slurry in Example 1 was changed to 5 parts (solids) of the slurry of titanium oxide microparticles, 8 parts of colloidal silica, 60 parts of ground calcium carbonate, and 27 parts of fine clay.

Example 6

A coated printing paper was obtained by the same procedure as in Example 1 except that the ester compound of a polyvalent alcohol and a fatty acid (KB-110 from Kao Corporation) was not used as an organic compound having the effect of inhibiting interfiber binding of pulp in the base paper in Example 1.

Comparative Example 1

A coated printing paper was obtained by the same procedure as in Example 1 except that the coated paper was treated in a hot soft nip calender with 2 nips at a metal roll surface temperature of 100° C., a paper feed speed of 1200 m/min, and a linear load of 300 kN/m after it was dried in Example 1.

Comparative Example 2

A coated printing paper was obtained by the same procedure as in Example 6 except that the coated paper was treated in a hot soft nip calender with 2 nips at a metal roll surface temperature of 100° C., a paper feed speed of 1200 m/min, and a linear load of 300 kN/m after it was dried in Example 6.

Comparative Examples 3

A coated printing paper was obtained by the same procedure as in Example 1 except that the composition of the pigment slurry in Example 1 was changed to 70 parts of ground calcium carbonate and 30 parts of fine clay.

The evaluation results are shown in Table 1.

TABLE 1

| | Oil absorbency under pressure (g/m$^2$) | Bekk smoothness (sec) | Ink receptivity | Ink drying properties | Print surface sharpness | Stickiness | Photocatalytic effect (%) |
|---|---|---|---|---|---|---|---|
| Example 1 | 56 | 31 | ◎ | ◎ | ◎ | ◎ | 64 |
| Example 2 | 70 | 33 | ◎ | ◎ | ◎ | ◎ | 32 |
| Example 3 | 74 | 35 | ◎ | ◎ | ◎ | ◎ | 18 |
| Example 4 | 90 | 25 | ○ | ◎ | ◎ | ◎ | 30 |
| Example 5 | 71 | 35 | ◎ | ◎ | ◎ | ◎ | 29 |
| Example 6 | 30 | 62 | ◎ | ○ | ◎ | ○ | 65 |
| Comparative example 1 | 30 | 90 | ◎ | X | ◎ | Δ | 65 |
| Comparative example 2 | 18 | 90 | ◎ | X | ◎ | X | 65 |
| Comparative example 3 | 60 | 30 | ◎ | ◎ | ◎ | ◎ | 0 |

Example 4

A coated printing paper was obtained by the same procedure as in Example 1 except that the composition of the pigment slurry in Example 1 was changed to 10 parts (solids) of the slurry of titanium oxide microparticles, 16 parts of colloidal silica, and 74 of ground calcium carbonate.

Example 5

A coated printing paper was obtained by the same procedure as in Example 1 except that the composition of the pigment slurry in Example 1 was changed to 10 parts (solids) of the slurry of titanium oxide microparticles, 66 parts of ground calcium carbonate, and 24 parts of fine clay.

What is claimed is:

1. A coated printing paper comprising a coating layer containing a pigment and an adhesive on a base paper, characterized in that calcium carbonate and a fine titanium oxide powder having a photocatalytic effect are contained in the coating layer and that the coated paper has an oil absorbency of 20 g/m$^2$ or more under pressure and a Bekk smoothness of 75 seconds or less, said fine titanium oxide having a primary particle size of 2 to 150 nm, and a mixture of a fine titanium oxide powder and colloidal silica, or a mixture of a fine titanium oxide powder and colloidal alumina, in a ratio of 5:1-1:5 being used as a pigment.

2. The coated printing paper of claim 1, characterized in that the fine titanium oxide powder is contained at 5 parts by weight or more and that the fine titanium oxide powder and calcium carbonate are contained at 30 parts by weight or more per 100 parts by weight of the pigment.

3. The coated printing paper of claim 2, characterized in that an organic compound having the effect of inhibiting interfiber binding of pulp is contained in the base paper.

4. The coated printing paper of claim 3, characterized in that the coating mass per side of the base paper is 3.0 $g/m^2$ or more.

5. The coated printing paper of claim 2, characterized in that the coating mass per side of the base paper is 3.0 $g/m^2$ or more.

6. The coated printing paper of claim 1, characterized in that an organic compound having the effect of inhibiting interfiber binding of pulp is contained in the base paper.

7. The coated printing paper of claim 6, characterized in that the coating mass per side of the base paper is 3.0 $g/m^2$ more.

8. The coated printing paper of claim 1, characterized in that the coating mass per side of the base paper is 3.0 $g/m^2$ or more.

9. The coated printing paper of claim 1, characterized in that said fine titanium oxide has a specific surface area of 10-350 $m^2/g$.

10. The coated printing paper of claim 1, characterized in that said coating layer contains a mixture of fine titanium dioxide and colloidal silica.

11. The coated printing paper of claim 1, characterized in that said coating layer contains a mixture of fine titanium dioxide and colloidal alumina.

12. A coated printing paper for use with a printing press, which consists essentially of a coating layer containing a pigment and an adhesive on a base paper, characterized in that a fine titanium oxide powder having a photocatalytic effect is contained in the coating layer and that the coated paper has an oil absorbency of 20 $g/m^2$ or more under pressure and a Bekk smoothness of 75 seconds or less, said fine titanium oxide having a primary particle size of 2 to 150 nm.

13. The coated printing paper of claim 12, characterized in that the fine titanium oxide powder is contained at 5 parts by weight or more and that the fine titanium oxide powder and calcium carbonate are contained at 30 parts by weight or more per 100 parts by weight of the pigment.

14. The coated printing paper of claim 12, characterized in that said coating layer contains calcium carbonate and a mixture of a fine titanium oxide powder and colloidal silica, or a mixture of a fine titanium oxide powder and colloidal alumina, in a ratio of 5:1-1:5 being used as a pigment.

15. The coated printing paper of claim 14, characterized in that said coating layer contains a mixture of a fine titanium oxide powder and colloidal silica.

16. The coated printing paper of claim 14, characterized in that said coating layer contains a mixture of a fine titanium oxide powder and colloidal alumina.

* * * * *